US007198683B2

(12) United States Patent
Agarwal et al.

(10) Patent No.: US 7,198,683 B2
(45) Date of Patent: Apr. 3, 2007

(54) STERLING SILVER ALLOY COMPOSITIONS OF EXCEPTIONAL AND REVERSIBLE HARDNESS, AND ENHANCED TARNISH RESISTANCE

(75) Inventors: Dwarika P. Agarwal, Attleboro, MA (US); Grigory Raykhtsaum, Sharon, MA (US)

(73) Assignee: Leach & Garner Company, North Attleboro, MA (US)

( * ) Notice: Subject to any disclaimer, the term of this patent is extended or adjusted under 35 U.S.C. 154(b) by 331 days.

(21) Appl. No.: 10/926,877

(22) Filed: Aug. 26, 2004

(65) Prior Publication Data

US 2006/0045792 A1 Mar. 2, 2006

(51) Int. Cl.
*C22C 5/00* (2006.01)
*C22C 5/08* (2006.01)

(52) U.S. Cl. ..... 148/431; 148/430; 420/502; 420/504

(58) Field of Classification Search ..... 148/430–431; 420/501–506

See application file for complete search history.

(56) References Cited

U.S. PATENT DOCUMENTS

| | | | | |
|---|---|---|---|---|
| 4,810,308 | A * | 3/1989 | Eagar et al. | 148/538 |
| 4,869,757 | A | 9/1989 | Eagar et al. | |
| 4,973,446 | A | 11/1990 | Bernhard et al. | |
| 5,037,708 | A | 8/1991 | Davitz | |
| 5,039,479 | A | 8/1991 | Bernhard et al. | |
| 5,558,833 | A | 9/1996 | Zamojski | |
| 5,817,195 | A | 10/1998 | Davitz | |
| 5,882,441 | A | 3/1999 | Davitz | |
| 6,406,664 | B1 | 6/2002 | Diamond | |
| 6,726,877 | B1 * | 4/2004 | Eccles | 420/504 |

* cited by examiner

*Primary Examiner*—Sikyin Ip
(74) *Attorney, Agent, or Firm*—Phillips Lytle LLP

(57) ABSTRACT

A sterling silver alloy composition of exceptional and reversible hardness and enhanced tarnish resistance, consists essentially of the following parts by weight: at least about 92.5% silver; about 4.4% to about 5.25% copper; about 0% to about 1.0% zinc; about 0.85% tin; about 0.05% to about 0.3% lithium; about 0.05% to about 0.5% silicon; about 0% to about 1.2% germanium; and about 0% to about 0.02% boron.

16 Claims, 3 Drawing Sheets

Table 1

| | Composition | | | | | | | | | Properties | | | |
|---|---|---|---|---|---|---|---|---|---|---|---|---|---|
| Alloy No. | %Ag | %Cu | %Zn | %Sn | %Li | %Si | %Ge | %B | Total | VHNwq* | Tarnish Rate | DE** | VHNht*** |
| 1 | 92.70 | 7.30 | 0 | 0 | 0 | 0 | 0 | 0 | 100.00 | 75 | 5.0 | 30-40 | 100 |
| 2 | 92.70 | 7.23 | 0 | 0 | 0 | 0.07 | 0 | 0 | 100.00 | 75 | 5.0 | 30-40 | 75 |
| 3 | 92.50 | 5.47 | 1.79 | 0 | 0 | 0 | 0.24 | 0 | 100.00 | 75 | 5.0 | 30-40 | 120 |
| 4 | 92.50 | 4.66 | 2.23 | 0.51 | 0 | 0.10 | 0 | 0 | 100.00 | 65 | 3.5 | 20-24 | 115 |
| 5 | 92.50 | 2.96 | 4.40 | 0 | 0 | 0.14 | 0 | 0 | 100.00 | 59 | 4.0 | 25-29 | 75 |
| 6 | 92.50 | 2.00 | 5.36 | 0 | 0 | 0.14 | 0 | 0 | 100.00 | 55 | 3.5 | 20-24 | 80 |
| 7 | 92.50 | 1.43 | 5.94 | 0 | 0 | 0.14 | 0 | 0 | 100.00 | 55 | 3.0 | 14-19 | 75 |
| 8 | 92.70 | 6.40 | 0 | 0.85 | 0.05 | 0 | 0 | 0 | 100.00 | 70 | 4.0 | 25-29 | 130 |
| 9 | 93.40 | 6.20 | 0 | 0.32 | 0.08 | 0 | 0 | 0 | 100.00 | 56 | 4.0 | 25-29 | 120 |
| 10 | 93.35 | 5.70 | 0 | 0.85 | 0.10 | 0 | 0 | 0 | 100.00 | 55 | 4.0 | 25-29 | 130 |
| 11 | 93.25 | 5.70 | 0 | 0.85 | 0.20 | 0 | 0 | 0 | 100.00 | 56 | 4.0 | 25-29 | 138 |
| 12 | 93.15 | 5.70 | 0 | 0.85 | 0.30 | 0 | 0 | 0 | 100.00 | 58 | 4.0 | 25-29 | 140 |
| 13 | 92.70 | 5.40 | 1.00 | 0.85 | 0.05 | 0 | 0 | 0 | 100.00 | 71 | 4.0 | 25-29 | 155 |
| 14 | 92.60 | 5.25 | 0.65 | 0.85 | 0.05 | 0.10 | 0.50 | 0 | 100.00 | 70 | 3.0 | 14-19 | 135 |
| 15 | 92.60 | 5.25 | 0.70 | 0.85 | 0.05 | 0.05 | 0.50 | 0 | 100.00 | 70 | 3.0 | 14-19 | 140 |
| 16 | 92.70 | 5.00 | 0.20 | 0.85 | 0.05 | 0 | 1.20 | 0 | 100.00 | 60 | 4.0 | 25-29 | 125 |
| 17 | 92.70 | 5.00 | 0.70 | 0.85 | 0.05 | 0.20 | 0.50 | 0 | 100.00 | 60 | 3.0 | 14-19 | 125 |
| 18 | 92.70 | 5.00 | 0.90 | 0.85 | 0.05 | 0.50 | 0 | 0 | 100.00 | 66 | 3.5 | 20-24 | 130 |

Table 1

| | Composition | | | | | | | | | Properties | | | |
|---|---|---|---|---|---|---|---|---|---|---|---|---|---|
| Alloy No. | %Ag | %Cu | %Zn | %Sn | %Li | %Si | %Ge | %B | Total | VHNwq* | Tarnish Rate | DE** | VHNht*** |
| 1 | 92.70 | 7.30 | 0 | 0 | 0 | 0 | 0 | 0 | 100.00 | 75 | 5.0 | 30-40 | 100 |
| 2 | 92.70 | 7.23 | 0 | 0 | 0 | 0.07 | 0 | 0 | 100.00 | 75 | 5.0 | 30-40 | 75 |
| 3 | 92.50 | 5.47 | 1.79 | 0 | 0 | 0 | 0.24 | 0 | 100.00 | 75 | 5.0 | 30-40 | 120 |
| 4 | 92.50 | 4.66 | 2.23 | 0.51 | 0 | 0.10 | 0 | 0 | 100.00 | 65 | 3.5 | 20-24 | 115 |
| 5 | 92.50 | 2.96 | 4.40 | 0 | 0 | 0.14 | 0 | 0 | 100.00 | 59 | 4.0 | 25-29 | 75 |
| 6 | 92.50 | 2.00 | 5.36 | 0 | 0 | 0.14 | 0 | 0 | 100.00 | 55 | 3.5 | 20-24 | 80 |
| 7 | 92.50 | 1.43 | 5.94 | 0 | 0 | 0.14 | 0 | 0 | 100.00 | 55 | 3.0 | 14-19 | 75 |
| 8 | 92.70 | 6.40 | 0 | 0.85 | 0.05 | 0 | 0 | 0 | 100.00 | 70 | 4.0 | 25-29 | 130 |
| 9 | 93.40 | 6.20 | 0 | 0.32 | 0.08 | 0 | 0 | 0 | 100.00 | 56 | 4.0 | 25-29 | 120 |
| 10 | 93.35 | 5.70 | 0 | 0.85 | 0.10 | 0 | 0 | 0 | 100.00 | 55 | 4.0 | 25-29 | 130 |
| 11 | 93.25 | 5.70 | 0 | 0.85 | 0.20 | 0 | 0 | 0 | 100.00 | 56 | 4.0 | 25-29 | 138 |
| 12 | 93.15 | 5.70 | 0 | 0.85 | 0.30 | 0 | 0 | 0 | 100.00 | 58 | 4.0 | 25-29 | 140 |
| 13 | 92.70 | 5.40 | 1.00 | 0.85 | 0.05 | 0 | 0 | 0 | 100.00 | 71 | 4.0 | 25-29 | 155 |
| 14 | 92.60 | 5.25 | 0.65 | 0.85 | 0.05 | 0.10 | 0.50 | 0 | 100.00 | 70 | 3.0 | 14-19 | 135 |
| 15 | 92.60 | 5.25 | 0.70 | 0.85 | 0.05 | 0.05 | 0.50 | 0 | 100.00 | 70 | 3.0 | 14-19 | 140 |
| 16 | 92.70 | 5.00 | 0.20 | 0.85 | 0.05 | 0 | 1.20 | 0 | 100.00 | 60 | 4.0 | 25-29 | 125 |
| 17 | 92.70 | 5.00 | 0.70 | 0.85 | 0.05 | 0.20 | 0.50 | 0 | 100.00 | 60 | 3.0 | 14-19 | 125 |
| 18 | 92.70 | 5.00 | 0.90 | 0.85 | 0.05 | 0.50 | 0 | 0 | 100.00 | 66 | 3.5 | 20-24 | 130 |

Fig. 2

Table 1

| | Composition | | | | | | | | | Properties | | | |
|---|---|---|---|---|---|---|---|---|---|---|---|---|---|
| Alloy No. | %Ag | %Cu | %Zn | %Sn | %Li | %Si | %Ge | %B | Total | VHNwq* | Tarnish Rate | DE** | VHNht*** |
| 19 | 92.70 | 5.00 | 1.20 | 0.85 | 0.05 | 0.20 | 0 | 0 | 100.00 | 65 | 4.0 | 25-29 | 135 |
| 20 | 92.70 | 5.00 | 0 | 0.85 | 0.05 | 0.20 | 1.20 | 0 | 100.00 | 65 | 3.0 | 14-19 | 130 |
| 21 | 92.70 | 4.40 | 2.00 | 0.85 | 0.05 | 0 | 0 | 0 | 100.00 | 65 | 4.0 | 25-29 | 125 |
| 22 | 92.70 | 3.40 | 3.00 | 0.85 | 0.05 | 0 | 0 | 0 | 100.00 | 53 | 4.0 | 25-29 | 63 |
| 23 | 92.60 | 5.24 | 0.65 | 0.85 | 0.05 | 0.10 | 0.50 | 0.01 | 100.00 | 70 | 3.0 | 14-19 | 135 |

VHNwq* = Vicker's Hardness in the soft annealed condition
DE** = Color difference range
VHNht*** = Vicker's Hardness after age hardening

Fig. 2 (cont'd.)

STERLING SILVER ALLOY COMPOSITIONS OF EXCEPTIONAL AND REVERSIBLE HARDNESS, AND ENHANCED TARNISH RESISTANCE

TECHNICAL FIELD

The present invention relates generally to sterling silver alloy compositions of exceptional and reversible hardness, and enhanced tarnish resistance.

BACKGROUND ART

To make sterling silver, 92.5% silver is alloyed with other alloys, such as 7.5% copper. While this results in sterling silver, the resulting alloy is relatively soft and tarnishable. As many will attest, conventional sterling silver tarnishes readily, and must typically be polished before use. The properties of sterling silver can be enhanced by increasing the hardness of the alloy, by making the hardness of such alloy reversible, and by providing enhanced tarnish resistance.

U.S. Pat. Nos. 4,810,308 and 4,869,757 discuss silver alloys with reversible hardness. However, these alloys contain high amounts of copper, and their tarnish resistance is not much better than that of conventional sterling silver alloys.

U.S. Pat. No. 4,973,446 discusses certain silver alloys that are designed to reduce fire scale. However, they only contain about 0.5% copper, and do not appear to show reversible hardness characteristics.

U.S. Pat. No. 5,037,708 broadly teaches that silver alloys may contain substantial amounts of palladium, which significantly increases the cost of the alloy.

U.S. Pat. No. 5,039,479 discloses silver alloys that contain no lithium, and are generally low in copper. The amount of copper is typically less than about 2.6%. These alloys do not exhibit desirable hardening characteristics.

U.S. Pat. No. 5,558,833 discloses silver alloys that are based on solver-indium formulations, and do not provide desirable hardening properties.

U.S. Pat. No. 5,817,195 discloses silver alloys containing about 0.25%–0.5% nickel. Nickel-containing alloys are thought to cause allergenic reactions.

U.S. Pat. No. 5,882,441 discloses silver alloys have no tin and a low copper percentage, and therefore do not show desirable hardening properties.

U.S. Pat. No. 6,406,664 teaches certain silver alloys containing nickel, and that do not contain lithium.

U.S. Pat. No. 6,726,877 again teaches silver alloys with no tin and no lithium.

The foregoing prior art references are hereby incorporated by reference with respect to the technical background of this invention.

DISCLOSURE OF THE INVENTION

The present invention broadly provides improved silver alloy compositions of exceptional and reversible hardness and enhanced tarnish resistance.

The improved compositions consist essentially of the following parts by weight: at least about 92.5% silver; about 4.4% to about 5.25% copper; about 0% to about 1.0% zinc; about 0.85% tin; about 0.05% to about 0.3% lithium; about 0.05% to about 0.5% silicon; about 0% to about 1.2% germanium; and about 0% to about 0.02% boron. The improved compositions exhibit a tarnish rate of not more than about 3.5 on a scale of from 0 to 5, where 0 is no tarnish and 5 is the tarnish rate of a sterling silver alloy having about 92.5% silver and about 7.5% copper when subjected for about six minutes to vapor of an aqueous solution containing about 650 parts per million of ammonium sulfide heated to a temperature of about 150° F. The improved compositions have an annealed hardness of about 60 VHN to about 70 VHN (i.e., when soft annealed by heating to a temperature of about 1200° F. in a non-oxidizing atmosphere, held at that temperature for about one hour, and then quenched in water). The improved compositions have a hardness of at least about 125 VHN when age hardened (i.e., by heating to a temperature of about 400° F., held at that temperature for about four hours, and then allowed to cool to room temperature).

A first particular alloy composition consists essentially of the following parts by weight: about 92.60% silver; about 5.25% copper; about 0.65% zinc; about 0.85% tin; about 0.05% lithium; about 0.10% silicon; and about 0.50% germanium. This composition exhibits a tarnish rate of about 3.0, has a hardness of about 70 VHN when annealed, and has a hardness of about 135 VHN when age hardened.

A second particular alloy composition consists essentially of the following parts by weight: about 92.60% silver; about 5.25% copper; about 0.70% zinc; about 0.85% tin; about 0.05% lithium; about 0.05% silicon; and about 0.50% germanium. This composition exhibits a tarnish rate of about 3.0, has a hardness of about 70 VHN when annealed, and has a hardness of about 140 VHN when age hardened.

A third particular alloy composition consists essentially of the following parts by weight: about 92.70% silver; about 5.00% copper; about 0.70% zinc; about 0.85% tin; about 0.05% lithium; about 0.20% silicon; and about 0.50% germanium. This composition exhibits a tarnish rate of about 3.0, has a hardness of about 60 VHN when annealed, and has a hardness of about 125 VHN when age hardened.

A fourth particular alloy composition consists essentially of the following parts by weight: about 92.70% silver; about 5.00% copper; about 0.90% zinc; about 0.85% tin; about 0.05% lithium; and about 0.50% silicon. This composition exhibits a tarnish rate of about 3.5, has a hardness of about 66 VHN when annealed, and has a hardness of about 130 VHN when age hardened.

A fifth particular alloy composition consists essentially of the following parts by weight: about 92.70% silver; about 5.00% copper; about 0% zinc; about 0.85% tin; about 0.05% lithium; about 0.20% silicon; and about 1.20% germanium. This composition exhibits a tarnish rate of about 3.0, has a hardness of about 65 VHN when annealed, and has a hardness of about 130 VHN when age hardened.

A sixth particular alloy composition consists essentially of the following parts by weight: about 92.60% silver; about 5.24% copper; about 0.65% zinc; about 0.85% tin; about 0.05% lithium; about 0.10% silicon; about 0.50% germanium; and about 0.01% boron. This composition exhibits a tarnish rate of about 3.0, has a hardness of about 70 VHN when annealed, and has a hardness of about 135 VHN when age hardened.

Accordingly, the general object of the invention is to provide improved sterling silver alloy compositions of exceptional and reversible hardness.

Another object is to provide improved sterling silver alloy compositions that are of enhanced tarnish resistance.

These and other objects and advantages will become apparent from the foregoing and ongoing written specification, the drawings, and the appended claims.

BRIEF DESCRIPTION OF THE DRAWINGS

FIG. 2 is a tabular presentation of certain data for various alloy compositions, some within and some without the scope of the present invention, and also indicates the properties of the various compositions.

DESCRIPTION OF THE PREFERRED EMBODIMENTS

Figure 1:
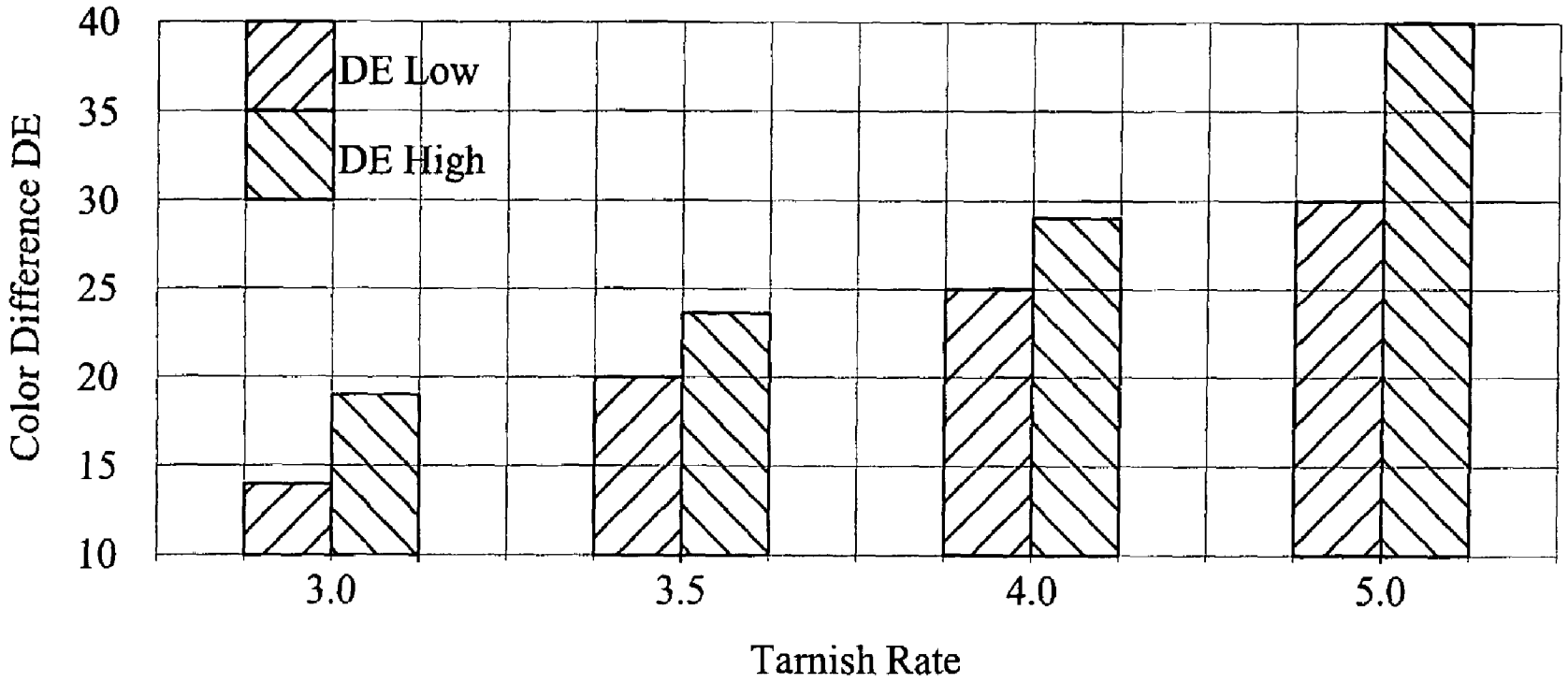
FIG. 1 is plot of color difference (DE) (ordinate) versus tarnish rate (abscissa), and shows the tarnish rate values as a bar graph function of color difference.

The present invention broadly various silver alloy compositions of exceptional and reversible hardness and enhanced tarnish resistance.

The improved compositions broadly include at least about 92.5% silver, about 4.4% to about 5.5% copper, about 0% to about 1.0% zinc, about 0.85% tin, about 0.05% to about 0.3% lithium, about 0.05% to about 0.5% silicon, about 0% to about 1.2% germanium, and about 0% to about 0.02% boron.

The improved compositions exhibit a tarnish rate of not more than about 3.5 on a scale from 0 to 5, where 0 is no tarnish and 5 is the tarnish rate of a sterling silver alloy having about 92.5% silver and about 7.5% copper when subjected for about six minutes to vapor from an aqueous solution containing about 650 parts per million of ammonium sulfide heated to a temperature of about 150° F.

The improved compositions have a Vickers Hardness Number ("VHN") of about 60 to about 70 when soft annealed by heating to a temperature of about 1200° F. in a non-oxidizing atmosphere, such as nitrogen or under vacuum conditions, held at that temperature for about one hour, and then quenched in water. The temperature of the water is not critical, although it is typically somewhere between room temperature and the boiling point of water.

The improved compositions have a hardness of about 125 VHN when age hardened by heating to a temperature of about 400° F., held to a temperature of about 400° F. for about four hours, and then allowed to cool to room temperature.

Tarnish ratings of the various alloys studied were determined by first subjecting carefully polished alloy disks to ammonium sulfide vapors. This tarnishing atmosphere was created by heating an aqueous solution containing about 650 parts per million of ammonium sulfide to a temperature of 150° F. The samples were exposed to the vapor for a period of about six minutes. In all cases, the color difference between regular sterling silver and the alloy under consideration was measured using a Macbeth color spectrophotometer. The detailed description of this procedure is given in U.S. Pat. No. 6,139,652, the aggregate disclosure of which is hereby incorporated by reference.

FIG. 1 illustrates the tarnish rate (abscissa) as a function of color difference DE. The data is not linear, and is provided as a bar graph. Thus, attested compositions having a color difference of about 14–19 have a tarnish rate of 3.0; compositions having a color difference from about 20–24 have a tarnish rate 3.5; compositions having a color difference from about 25–29 have a tarnish rate of 4.0, and compositions having a color difference from about 30–40 have a tarnish rate of 5.0.

Applicants' data showing various tested alloys is set forth in FIG. 2.

Alloy No. 1 contains 92.7% Ag, 7.30% Cu, 0% Zn, 0% Sn, 0% Li, 0% Si, 0% Ge, and 0% B. This alloy was found to have a hardness of about 75 VHN when soft annealed, and a hardness of about 100 VHN when age hardened. The color difference was measured to be 30–40 DE, and the tarnish rate was about 5.0.

Alloy No. 2 contains 92.7% Ag, 7.23% Cu, 0% Zn, 0% Sn, 0% Li, 0.07% Si, 0% Ge, and 0% B. This alloy was found to have a hardness of about 75 VHN when soft annealed, and a hardness of about 75 VHN when age hardened. The color difference was measured to be 30–40 DE, and the tarnish rate was about 5.0.

Alloy No. 3 contains 92.5% Ag, 5.47% Cu, 1.79% Zn, 0% Sn, 0% Li, 0% Si, 0.24% Ge, and 0% B. This alloy was found to have a hardness of about 75 VHN when soft annealed, and a hardness of about 120 VHN when age hardened. The color difference was measured to be 30–40 DE, and the tarnish rate was about 5.0.

Alloy No. 4 contains 92.5% Ag, 4.66% Cu, 2.23% Zn, 0.51% Sn, 0% Li, 0.10% Si, 0% Ge, and 0% B. This alloy was found to have a hardness of about 65 VHN when soft annealed, and a hardness of about 115 VHN when age hardened. The color difference was measured to be 20–24 DE, and the tarnish rate was about 3.5.

Alloy No. 5 contains 92.5% Ag, 2.96% Cu, 4.40% Zn, 0% Sn, 0% Li, 0.14% Si, 0% Ge, and 0% B. This alloy was found to have a hardness of about 59 VHN when soft annealed, and a hardness of about 75 VHN when age hardened. The color difference was measured to be 25–29 DE, and the tarnish rate was about 4.0.

Alloy No. 6 contains 92.5% Ag, 2.00% Cu, 5.36% Zn, 0% Sn, 0% Li, 0.14% Si, 0% Ge, and 0% B. This alloy was found to have a hardness of about 55 VHN when soft annealed, and a hardness of about 80 VHN when age hardened. The color difference was measured to be 20–24 DE, and the tarnish rate was about 3.5.

Alloy No. 7 contains 92.5% Ag, 1.43% Cu, 5.94% Zn, 0% Sn, 0% Li, 0.14% Si, 0% Ge, and 0% B. This alloy was found to have a hardness of about 55 VHN when soft annealed, and a hardness of about 75 VHN when age hardened. The color difference was measured to be 14–19 DE, and the tarnish rate was about 3.0.

Alloy No. 8 contains 92.7% Ag, 6.40% Cu, 0% Zn, 0.85% Sn, 0.05% Li, 0% Si, 0% Ge, and 0% B. This alloy was found to have a hardness of about 70 VHN when soft annealed, and a hardness of about 130 VHN when age hardened. The color difference was measured to be 25–29 DE, and the tarnish rate was about 4.0.

Alloy No. 9 contains 93.4% Ag, 6.20% Cu, 0% Zn, 0.32% Sn, 0.08% Li, 0% Si, 0% Ge, and 0% B. This alloy was found to have a hardness of about 56 VHN when soft annealed, and a hardness of about 120 VHN when age hardened. The color difference was measured to be 25–29 DE, and the tarnish rate was about 4.0.

Alloy No. 10 contains 93.35% Ag, 5.70% Cu, 0% Zn, 0.85% Sn, 0.10% Li, 0% Si, 0% Ge, and 0% B. This alloy was found to have a hardness of about 55 VHN when soft annealed, and a hardness of about 130 VHN when age hardened. The color difference was measured to be 25–29 DE, and the tarnish rate was about 4.0.

Alloy No. 11 contains 93.25% Ag, 5.70% Cu, 0% Zn, 0.85% Sn, 0.20% Li, 0% Si, 0% Ge, and 0% B. This alloy was found to have a hardness of about 56 VHN when soft annealed, and a hardness of about 138 VHN when age hardened. The color difference was measured to be 25–29 DE, and the tarnish rate was about 4.0.

Alloy No. 12 contains 93.15% Ag, 5.70% Cu, 0% Zn, 0.85% Sn, 0.30% Li, 0% Si, 0% Ge, and 0% B. This alloy was found to have a hardness of about 58 VHN when soft annealed, and a hardness of about 140 VHN when age hardened. The color difference was measured to be 25–29 DE, and the tarnish rate was about 4.0.

Alloy No. 13 contains 92.7% Ag, 5.40% Cu, 1.00% Zn, 0.85% Sn, 0.05% Li, 0% Si, 0% Ge, and 0% B. This alloy was found to have a hardness of about 71 VHN when soft annealed, and a hardness of about 155 VHN when age hardened. The color difference was measured to be 25–29 DE, and the tarnish rate was about 4.0.

Alloy No. 14 contains 92.6% Ag, 5.25% Cu, 0.65% Zn, 0.85% Sn, 0.05% Li, 0.10% Si, 0.50% Ge, and 0% B. This alloy was found to have a hardness of about 70 VHN when soft annealed, and a hardness of about 135 VHN when age hardened. The color difference was measured to be 14–19 DE, and the tarnish rate was about 3.0.

Alloy No. 15 contains 92.6% Ag, 5.25% Cu, 0.70% Zn, 0.85% Sn, 0.05% Li, 0.05% Si, 0.50% Ge, and 0% B. This alloy was found to have a hardness of about 70 VHN when soft annealed, and a hardness of about 140 VHN when age hardened. The color difference was measured to be 14–19 DE, and the tarnish rate was about 3.0.

Alloy No. 16 contains 92.7% Ag, 5.00% Cu, 0.20% Zn, 0.85% Sn, 0.05% Li, 0% Si, 1.20% Ge, and 0% B. This alloy was found to have a hardness of about 60 VHN when soft annealed, and a hardness of about 125 VHN when age hardened. The color difference was measured to be 25–29 DE, and the tarnish rate was about 4.0.

Alloy No. 17 contains 92.7% Ag, 5.00% Cu, 0.70% Zn, 0.85% Sn, 0.05% Li, 0.20% Si, 0.50% Ge, and 0% B. This alloy was found to have a hardness of about 60 VHN when soft annealed, and a hardness of about 125 VHN when age hardened. The color difference was measured to be 14–19 DE, and the tarnish rate was about 3.0.

Alloy No. 18 contains 92.7% Ag, 5.00% Cu, 0.90% Zn, 0.85% Sn, 0.05% Li, 0.50% Si, 0% Ge, and 0% B. This alloy was found to have a hardness of about 66 VHN when soft annealed, and a hardness of about 130 VHN when age hardened. The color difference was measured to be 20–24 DE, and the tarnish rate was about 3.5.

Alloy No. 19 contains 92.7% Ag, 5.00% Cu, 1.20% Zn, 0.85% Sn, 0.05% Li, 0.20% Si, 0% Ge, and 0% B. This alloy was found to have a hardness of about 65 VHN when soft annealed, and a hardness of about 135 VHN when age hardened. The color difference was measured to be 25–29 DE, and the tarnish rate was about 4.0.

Alloy No. 20 contains 92.7% Ag, 5.00% Cu, 0% Zn, 0.85% Sn, 0.05% Li, 0.20% Si, 1.20% Ge, and 0% B. This alloy was found to have a hardness of about 65 VHN when soft annealed, and a hardness of about 130 VHN when age hardened. The color difference was measured to be 14–19 DE, and the tarnish rate was about 3.0.

Alloy No. 21 contains 92.7% Ag, 4.40% Cu, 2.00% Zn, 0.85% Sn, 0.05% Li, 0% Si, 0% Ge, and 0% B. This alloy was found to have a hardness of about 65 VHN when soft annealed, and a hardness of about 125 VHN when age hardened. The color difference was measured to be 25–29 DE, and the tarnish rate was about 4.0.

Alloy No. 22 contains 92.7% Ag, 3.40% Cu, 3.00% Zn, 0.85% Sn, 0.05% Li, 0% Si, 0% Ge, and 0% B. This alloy was found to have a hardness of about 53 VHN when soft annealed, and a hardness of about 63 VHN when age hardened. The color difference was measured to be 25–29 DE, and the tarnish rate was about 4.0.

Alloy No. 23 contains 92.6% Ag, 5.24% Cu, 0.65% Zn, 0.85% Sn, 0.05% Li, 0.10% Si, 0.50% Ge, and 0.01% B. This alloy was found to have a hardness of about 70 VHN when soft annealed, and a hardness of about 135 VHN when age hardened. The color difference was measured to be 14–19 DE, and the tarnish rate was about 3.0.

Thus, of the foregoing alloys, only alloys 14, 15, 17, 18, 20, and 23 have the desired properties and fall within the scope of the appended claims. The hardness of the alloys is reversible by either soft annealing the product, or by age hardening it. In other words, a soft annealed product may be hardened by age hardening the alloy. Conversely, an age hardened product may be softened by annealing it.

Therefore, the present invention broadly provides improved sterling silver alloy compositions of exceptional and reversible hardness, and enhanced tarnish resistance.

What is claimed is:

1. A sterling silver alloy composition of exceptional and reversible hardness and enhanced tarnish resistance, consisting of the following parts by weight:

at least about 92.5% silver;
about 5.0% to about 5.25% copper;
about 0% to about 1.0% zinc;
about 0.85% tin;
about 0.05% lithium;
about 0.05% to about 0.5% silicon;
about 0% to about 1.2% germanium; and
about 0% to about 0.01% boron.

2. A sterling silver alloy composition of exceptional and reversible hardness and enhanced tarnish resistance, as set forth in claim 1 wherein said composition exhibits a tarnish rate of not more than about 3.5 on a scale of from 0 to 5, where 0 is no tarnish and 5 is the tarnish rate of a sterling silver alloy having about 92.5% silver and about 7.5% copper when subjected for about six minutes to vapor of an aqueous solution containing about 650 parts per million of ammonium sulfide heated to a temperature of about 150° F.

3. A sterling silver alloy composition of exceptional and reversible hardness and enhanced tarnish resistance, as set forth in claim 1 wherein said composition has a hardness of about 60 VHN to about 70 VHN when soft annealed by heating to a temperature of about 1200° F. in a non-oxidizing atmosphere, held at a temperature of about 1200° F. for about one hour, and then quenched in water.

4. A sterling silver alloy composition of exceptional and reversible hardness and enhanced tarnish resistance, as set forth in claim 1 wherein said composition has a hardness of at least about 125 VHN when age hardened by heating to a temperature of about 400° F., held at a temperature of about 400° F. for about four hours, and then allowed to cool to room temperature.

5. A sterling silver alloy composition of exceptional and reversible hardness and enhanced tarnish resistance, as set forth in claim 1 consisting of the following parts by weight:

about 92.60% silver;
about 5.25% copper;
about 0.65% zinc;
about 0.85% tin;
about 0.05% lithium;
about 0.10% silicon; and
about 0.50% germanium.

6. A sterling silver alloy composition of exceptional and reversible hardness and enhanced tarnish resistance, as set forth in claim 5 wherein said composition exhibits a tarnish rate of about 3.0 on a scale of from 0 to 5, where 0 is no tarnish and 5 is the tarnish rate of a sterling silver alloy having about 92.5% silver and about 7.5% copper when subjected for about six minutes to vapor of an aqueous solution containing about 650 parts per million of ammonium sulfide heated to a temperature of about 150° F., and wherein said composition has a hardness of about 135 VHN when age hardened by heating to a temperature of about 400° F., held at a temperature of about 400° F. for about four hours, and then allowed to cool to room temperature.

7. A sterling silver alloy composition of exceptional and reversible hardness and enhanced tarnish resistance, as set forth in claim 1 consisting of the following parts by weight:

about 92.60% silver;
about 5.25% copper;
about 0.70% zinc;
about 0.85% tin;
about 0.05% lithium;
about 0.05% silicon; and
about 0.50% germanium.

8. A sterling silver alloy composition of exceptional and reversible hardness and enhanced tarnish resistance, as set forth in claim 7 wherein said composition exhibits a tarnish rate of about 3.0 on a scale of from 0 to 5, where 0 is no tarnish and 5 is the tarnish rate of a sterling silver alloy having about 92.5% silver and about 7.5% copper when subjected for about six minutes to vapor of an aqueous solution containing about 650 parts per million of ammonium sulfide heated to a temperature of about 150° F., and wherein said composition has a hardness of about 140 VHN when age hardened by heating to a temperature of about 400° F., held at a temperature of about 400° F. for about four hours, and then allowed to cool to room temperature.

9. A sterling silver alloy composition of exceptional and reversible hardness and enhanced tarnish resistance, as set forth in claim 1 consisting of the following parts by weight:

about 92.70% silver;
about 5.00% copper;
about 0.70% zinc;
about 0.85% tin;
about 0.05% lithium;
about 0.20% silicon; and
about 0.50% germanium.

10. A sterling silver alloy composition of exceptional and reversible hardness and enhanced tarnish resistance, as set forth in claim 9 wherein said composition exhibits a tarnish rate of about 3.0 on a scale of from 0 to 5, where 0 is no tarnish and 5 is the tarnish rate of a sterling silver alloy having about 92.5% silver and about 7.5% copper when subjected for about six minutes to vapor of an aqueous solution containing about 650 parts per million of ammonium sulfide heated to a temperature of about 150° F., and wherein said composition has a hardness of about 125 VHN when age hardened by heating to a temperature of about 400° F., held at a temperature of about 400° F. for about four hours, and then allowed to cool to room temperature.

11. A sterling silver alloy composition of exceptional and reversible hardness and enhanced tarnish resistance, as set forth in claim 1 consisting of the following parts by weight:

about 92.70% silver;
about 5.00% copper;
about 0.90% zinc;
about 0.85% tin;
about 0.05% lithium; and
about 0.50% silicon.

12. A sterling silver alloy composition of exceptional and reversible hardness and enhanced tarnish resistance, as set forth in claim 11 wherein said composition exhibits a tarnish rate of about 3.5 on a scale of from 0 to 5, where 0 is no tarnish and 5 is the tarnish rate of a sterling silver alloy having about 92.5% silver and about 7.5% copper when subjected for about six minutes to vapor of an aqueous solution containing about 650 parts per million of ammonium sulfide heated to a temperature of about 150° F., and wherein said composition has a hardness of about 130 VHN when age hardened by heating to a temperature of about 400° F., held at a temperature of about 400° F. for about four hours, and then allowed to cool to room temperature.

13. A sterling silver alloy composition of exceptional and reversible hardness and enhanced tarnish resistance, as set forth in claim 1 consisting of the following parts by weight:

about 92.70% silver;
about 5.00% copper;
about 0% zinc;
about 0.85% tin;
about 0.05% lithium;
about 0.20% silicon; and
about 1.20% germanium.

14. A sterling silver alloy composition of exceptional and reversible hardness and enhanced tarnish resistance, as set forth in claim 13 wherein said composition exhibits a tarnish rate of about 3.0 on a scale of from 0 to 5, where 0 is no tarnish and 5 is the tarnish rate of a sterling silver alloy having about 92.5% silver and about 7.5% copper when subjected for about six minutes to vapor of an aqueous solution containing about 650 parts per million of ammonium sulfide heated to a temperature of about 150° F., and wherein said composition has a hardness of about 130 VHN when age hardened by heating to a temperature of about 400° F., held at a temperature of about 400° F. for about four hours, and then allowed to cool to room temperature.

15. A sterling silver alloy composition of exceptional and reversible hardness and enhanced as set forth in claim 1 consisting of the following parts by weight:

about 92.60% silver;
about 5.24% copper;
about 0.65% zinc;
about 0.85% tin;
about 0.05% lithium;
about 0.10% silicon;
about 0.50% germanium; and
about 0.01% boron.

16. A sterling silver alloy composition of exceptional and reversible hardness and enhanced tarnish resistance, as set forth in claim 15 wherein said composition exhibits a tarnish rate of about 3.0 on a scale of from 0 to 5, where 0 is no tarnish and 5 is the tarnish rate of a sterling silver alloy having about 92.5% silver and about 7.5% copper when subjected for about six minutes to vapor of an aqueous solution containing about 650 parts per million of ammonium sulfide heated to a temperature of about 150° F., and wherein said composition has a hardness of about 135 VHN when age hardened by heating to a temperature of about 400° F., held at a temperature of about 400° F. for about four hours, and then allowed to cool to room temperature.

* * * * *